US010619343B2

(12) United States Patent
Heady et al.

(10) Patent No.: US 10,619,343 B2
(45) **Date of Patent: *Apr. 14, 2020**

(54) ADJUSTABLE FOUNDATION SUPPORT SYSTEM

(71) Applicant: POWER BRACE, LLC, Des Moines, IA (US)

(72) Inventors: Timothy P. Heady, Elkhart, IA (US); Charles W. Heady, Perry, IA (US)

(73) Assignee: Power Brace, LLC, Des Moines, IA (US)

( * ) Notice: Subject to any disclaimer, the term of this patent is extended or adjusted under 35 U.S.C. 154(b) by 12 days.

This patent is subject to a terminal disclaimer.

(21) Appl. No.: 15/970,053

(22) Filed: May 3, 2018

(65) Prior Publication Data

US 2018/0347178 A1 Dec. 6, 2018

Related U.S. Application Data

(63) Continuation-in-part of application No. 15/939,404, filed on Mar. 29, 2018.

(Continued)

(51) Int. Cl.

| | |
|---|---|
| ***E04B 1/58*** | (2006.01) |
| ***E04B 1/41*** | (2006.01) |
| ***B21D 5/02*** | (2006.01) |
| ***E02D 27/02*** | (2006.01) |
| ***E04G 23/02*** | (2006.01) |

(Continued)

(52) U.S. Cl.

CPC ..... *E04B 1/40* (2013.01); *B21D 5/02* (2013.01); *E02D 27/02* (2013.01); *E04B 1/58* (2013.01); *E04G 23/0229* (2013.01); *E04B 1/0007* (2013.01); *E04B 1/5812* (2013.01); *E04B 2001/246* (2013.01); *E04B 2001/405* (2013.01); *E04B 2001/5875* (2013.01)

(58) Field of Classification Search

CPC ..... E04B 1/5812; E04B 2001/405; E04B 2001/2415; E04B 2001/246; E04B 2001/5875; E04B 2001/2424; E02D 2200/115; E02D 5/526

See application file for complete search history.

(56) References Cited

U.S. PATENT DOCUMENTS 2,953,224 A * 9/1960 Pollini ..... E04B 1/5812 403/387
3,047,110 A * 7/1962 Saha ..... E04B 1/58 403/189

(Continued)

*Primary Examiner* — Bradley Duckworth
(74) *Attorney, Agent, or Firm* — McKee, Voorhees & Sease, PLC

(57) ABSTRACT

An extension support member includes a bracket or web having a first planar portion or leg, a second planar portion or leg, an acute, concave angle between the first planar portion or leg and the second planar portion or leg, and a bend or backbone joining the first planar portion or leg to the second planar portion or leg. The extension support member also includes is a first mounting portion or tab joined to the second planar portion or leg via the bend or backbone at a first, convex obtuse angle and a second mounting portion or tab joined to the first planar portion or leg via the bend or backbone at a second obtuse, convex angle. The first mounting portion and the second mounting portion are located at opposite ends of the bracket or web.

16 Claims, 11 Drawing Sheets

Related U.S. Application Data

(60) Provisional application No. 62/515,824, filed on Jun. 6, 2017.

(51) Int. Cl.

| | |
|---|---|
| *E04B 1/38* | (2006.01) |
| *E04B 1/00* | (2006.01) |
| *E04B 1/24* | (2006.01) |

(56) References Cited

U.S. PATENT DOCUMENTS

| | | | | |
|---|---|---|---|---|
| 6,230,467 | B1 * | 5/2001 | Leek | E04B 1/2403 403/232.1 |
| 7,461,493 | B2 * | 12/2008 | Quertelet | B21D 53/40 52/285.1 |
| 8,347,579 | B2 * | 1/2013 | Gan | E04B 1/2403 52/653.1 |
| 8,397,458 | B2 * | 3/2013 | Tedesco | E04B 9/18 52/506.05 |
| 8,973,333 | B2 * | 3/2015 | Sugihara | E04B 1/2403 52/655.1 |
| 9,003,738 | B1 * | 4/2015 | Evans, Jr. | E04B 5/12 52/702 |
| 10,370,842 | B2 * | 8/2019 | Wesney | E04B 1/40 |
| 2017/0089059 | A1 * | 3/2017 | Farre Berga | E04B 1/24 |
| 2018/0135293 | A1 * | 5/2018 | Daudet | E04B 2/768 |
| 2018/0142463 | A1 * | 5/2018 | Siddhartha | E04B 1/40 |
| 2018/0171620 | A1 * | 6/2018 | Allen | E04B 1/2612 |
| 2019/0071859 | A1 * | 3/2019 | Gill | E04B 1/3445 |

* cited by examiner

ADJUSTABLE FOUNDATION SUPPORT SYSTEM

CROSS-REFERENCE TO RELATED APPLICATIONS

The Present Applications is a Continuation-in-part Patent Applications of co-pending U.S. Utility patent application Ser. No. 15/939,404, filed Mar. 29, 2018, which is a Conversion Patent Applications of U.S. Provisional Patent Application Ser. No. 62/515,824, filed Jun. 6, 2017. These applications are herein incorporated by reference in their entirety, including without limitation, the specification, claims, and abstract, as well as any figures, tables, or drawings thereof.

FIELD OF THE INVENTION

The present disclosure relates generally to an adjustable foundation support system. More particularly, but not exclusively, the present disclosure relates to a system utilizing special extension support members that allow two vertical support members to be secured to one another.

BACKGROUND OF THE INVENTION

Many of today's homes include basements, which are at least partially subterranean. The basement foundation walls are designed to support vertical loads more so than lateral loads from the surrounding earth. As a result, upon exposure to excessive lateral forces, foundation walls often crack, bow, push inward, or even collapse. The forces are associated with expansive soils, hydrostatic pressure, water pooling from downspouts, or freezing ground water, foundation settlement, and the like.

The foundation reinforcement systems commonly known in the art are deficient for a variety reasons. For example, these foundation systems commonly employ the use of specific vertical support members that require welding on site or that a variety of support member lengths be transported to the site. Thus, a need exists in the art for an extension that allows a vertical support member to be extended as needed on site without the need for welding or carrying a variety of support member lengths.

BRIEF SUMMARY OF THE INVENTION

Therefore, it is a primary object, feature, or advantage of the invention to improve on or overcome the deficiencies in the art.

It is another object, feature, or advantage of the invention to provide an extension system including extension support members configured to allow a vertical support member to be extended as needed on site without the need for welding or carrying a variety of support member lengths.

It is still yet a further object, feature, or advantage of the invention to provide extension brackets to operatively secure a first, vertical support member to a second, vertical, and typically shorter support member.

It is still yet a further object, feature, or advantage of the invention to place the means for fastening the vertical support members around a portion of the vertical support member and a portion of the extension bracket and to preferably hold the vertical support member in close proximity with the extension bracket.

It is still yet a further object, feature, or advantage of the invention to provide additional extension support members that are secured to one another through one or more nut and bolt assemblies to improve securement between the vertical support members and the extension brackets and to strengthen the extension support member by resting the extension support member on the bottom nut and bolt assembly while simultaneously providing a sheath or additional bracketing to further support by the top nut and bolt assembly.

It is still yet a further object, feature, or advantage of the invention to reduce the number of parts used to form the extension system, while still safely reinforcing a subterranean wall.

It is still yet a further object, feature, or advantage of the invention to provide friction between the brackets and the extension support member to aid in bearing some of the weight of the extension support member.

It is still yet a further object, feature, or advantage of the invention to provide a wall reinforcement system and an extension system that maximize the interior space proximate to the wall and are aesthetically pleasing.

It is still yet a further object, feature, or advantage of the invention to provide a wall reinforcement system and an extension system that are durable and cost effective.

According to some aspects of the disclosure, an extension support member includes a bracket or web having a first planar portion or leg, a second planar portion or leg, an acute, concave angle between the first planar portion or leg and the second planar portion or leg, and a bend or backbone joining the first planar portion or leg to the second planar portion or leg. The extension support member also includes is a first mounting portion or tab joined to the second planar portion or leg via the bend or backbone at a first obtuse, convex angle and a second mounting portion or tab joined to the first planar portion or leg via the bend or backbone at a second obtuse, convex angle. The first mounting portion and the second mounting portion are located at opposite ends of the bracket or web.

According to other aspects of the disclosure, the extension support member may be made from the method comprising providing an S-shaped sheet of metal, folding the S-shaped sheet of metal along a longitudinal axis at an acute, concave angle to form the bracket or web, cutting a first mounting portion or tab out of the bracket or web by horizontally cutting the bracket or web a first distance below a first end of the bracket, cutting a second mounting portion or tab out of the bracket or web by horizontally cutting the bracket a second distance above the second end of the bracket or web, wherein the first mounting portion or tab and the second mounting portion or tab are located on opposite sides of the bracket or web, punching apertures through the first mounting portion or tab and the second mounting portion, and folding the mounting portions or tabs such that the mounting portions or tabs are located within the same plane.

These or other objects, features, and advantages of the invention will be apparent to those skilled in the art. The invention is not to be limited to or by these objects, features and advantages. No single embodiment need provide each and every object, feature, or advantage.

Figure 1:
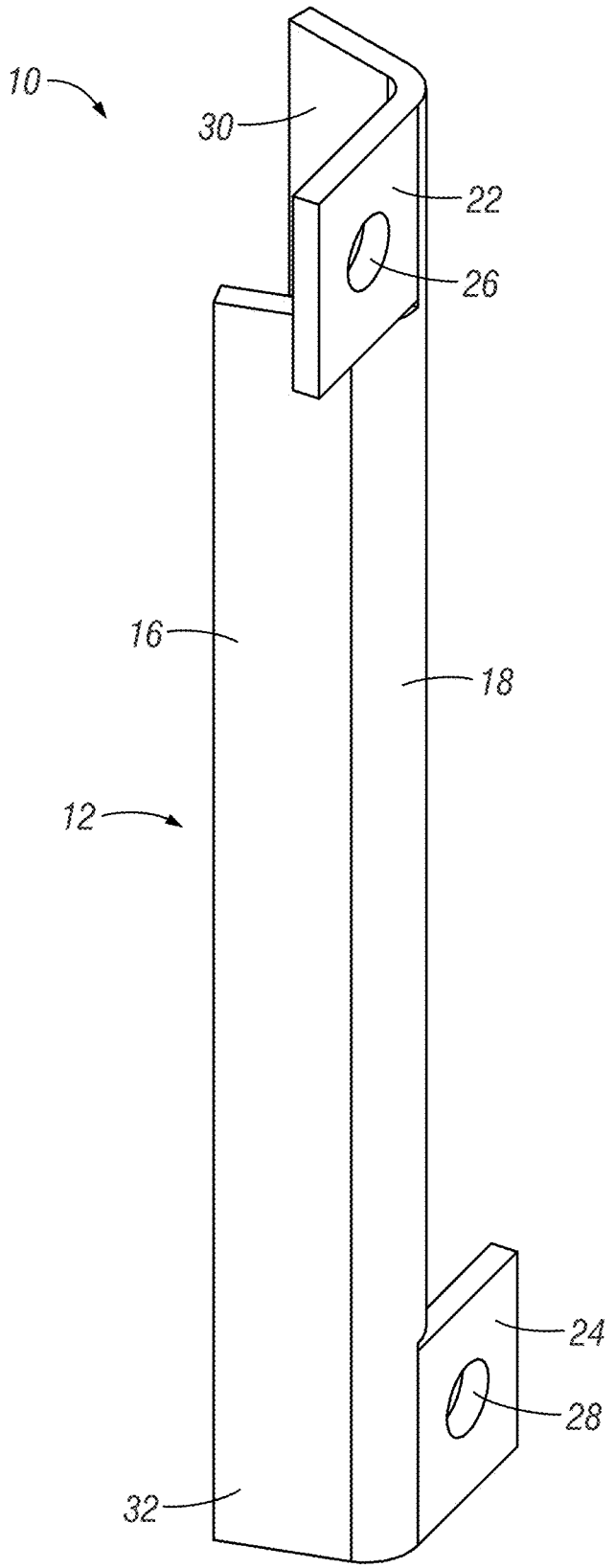
FIG. 1 is a perspective view of a support member bracket, according to aspects of the disclosure.

Various embodiments of the invention will be described in detail with reference to the drawings, wherein like reference numerals represent like parts throughout the several views. Reference to various embodiments does not limit the scope of the invention. Figures represented herein are not limitations to the various embodiments according to the invention and are presented for exemplary illustration of the invention.

DETAILED DESCRIPTION

The following definitions and introductory matters are provided to facilitate an understanding of the present invention.

The singular terms "a," "an," and "the" include plural referents unless context clearly indicates otherwise. Similarly, the word "or" is intended to include "and" unless the context clearly indicate otherwise. The word "or" means any one member of a particular list and also includes any combination of members of that list.

Reference is made to the accompanying drawings which form a part hereof, and in which is shown by way of illustration specific embodiments in which the invention may be practiced. These embodiments of the invention will be described in detail with reference to the drawings, wherein like reference numerals represent like parts throughout the several views. These embodiments are described in sufficient detail to enable those skilled in the art to practice the invention, and it is to be understood that other embodiments may be utilized and that mechanical, procedural, and other changes may be made without departing from the spirit and scope of the invention. The following detailed description is, therefore, not to be taken in a limiting sense, and the scope of the invention is defined only by the appended claims, along with the full scope of equivalents to which such claims are entitled.

As used herein, the terminology such as first, second, vertical, horizontal, top, bottom, upper, lower, front, rear, end, sides, concave, convex, and the like, are referenced according to the views presented. It should be understood, however, that the terms are used only for purposes of description and are not intended to be used as limitations. Accordingly, orientation of an object or a combination of objects may change without departing from the scope of the invention.

FIGS. 1-4 show various views of an extension support member 10. The extension support member includes a bracket or web 12. The bracket or web 12 includes a first planar portion or leg 14, a second planar portion or leg 16, an acute angle 20 between the first planar portion or leg 14 and the second planar portion or leg 16, and a bend or backbone 18 joining the first planar portion or leg 14 to the second planar portion or leg 16. The bracket or web 12 may be made out of a single piece of molded or formed material, so long as the material is strong enough to support the weight of the extension support member 10 and the forces applied through a vertical extension support member to the extension support member 10. The bracket or web 12 may be substantially u-shaped or v-shaped. The bend or backbone 18 may be a radial bend, may form an edge, or may be reinforced to provide for extra strength and to prevent failure.

The bracket or web 12 also includes a first mounting portion or tab 22 joined to the second planar portion or leg 16 via the bend or backbone 18 at a first obtuse angle 34 and a second mounting portion or tab 24 joined to the first planar portion or leg 14 via the bend or backbone 18 at a second obtuse angle 36. In the embodiment shown in FIGS. 1-4, the acute angle 20, the first obtuse angle 34, and the second obtuse angle 36 are all oriented to be concave (curving inward).

The first mounting portion or tab 22 is located at a first end or extension 30 of the bracket or web 12 and the second mounting portion or tab 24 is located at an opposite, second end or extension 32 of the bracket or web 12. The first mounting portion or tab 22 may include a first aperture 26 and the second mounting portion or tab 24 may include a second aperture 28. The mounting portion or first tab 22 and the second mounting portion or tab 24 may be positioned within the same plane. According to some aspects of the disclosure, the second planar portion or leg 16 may extend the length of the first mounting portion or tab 22 at the first end or extension 30 and the first planar portion or leg 14 may extend the length of the second mounting portion or tab 24 at the second end or extension 32. The mounting portions or tabs 22, 24 are shown as rectangles, but may be ovals (including circular), partial ovals (including semicircles), regular polygons (including equilateral triangles, etc.), irregular polygons, cones, any other known shapes, or any combination of the preceding shapes. Likewise, the apertures 26, 28 are shown as circles, but may be ovals (including circular), partial ovals (including semicircles), regular polygons (including equilateral triangles, etc.), irregular polygons, cones, any other known shapes, or any combination of the preceding shapes. The apertures are shown centrally located within the mounting portions or tabs 22, 24 but are not limited to such a location.

The extension support member 10 may also be made from the method comprising providing a rectangular sheet of metal, folding the rectangular sheet of metal along a longitudinal axis at an acute angle 20 to form the bracket or web 12, cutting a first mounting portion or tab 22 out of the bracket or web 12 by horizontally cutting the bracket or web 12 a first distance below a first end of the bracket, cutting a second mounting portion or tab 24 out of the bracket or web 12 by horizontally cutting the bracket a second distance above the second end of the bracket or web 12, wherein the first mounting portion or tab 22 and the second mounting portion or tab 24 are located on opposite sides of the bracket or web 12, punching apertures 26, 28 through the first mounting portion or tab 22 and the second mounting portion 24, and folding the mounting portions or tabs 22, 24 such that the mounting portions or tabs 22, 24 are located within the same plane. The first distance and the second distance may be equal.

Figure 2:
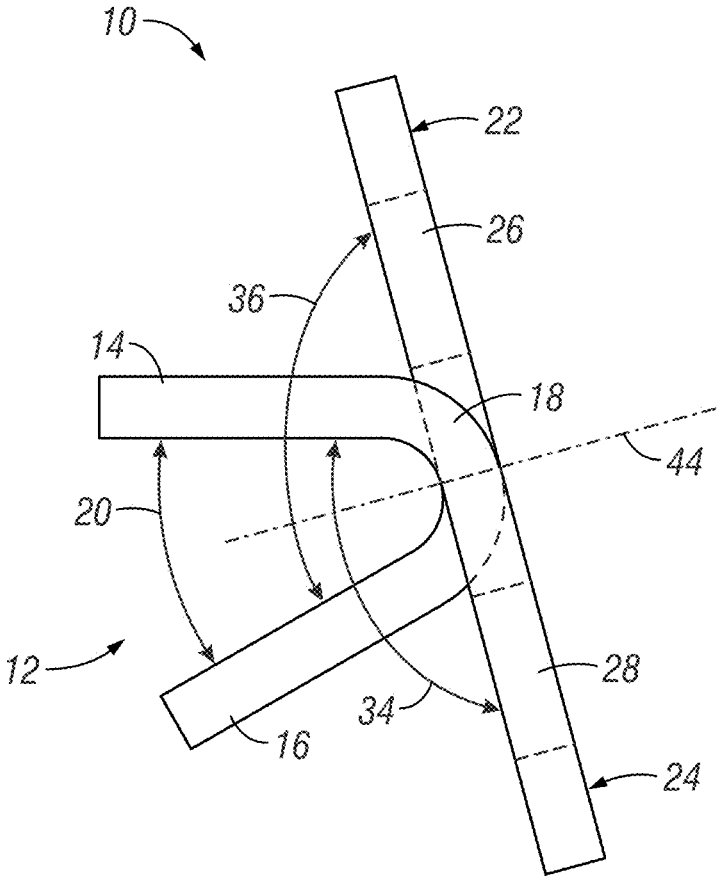
FIG. 2 is a top view of the support member bracket of FIG. 1 according to aspects of the disclosure.
Figure 3:
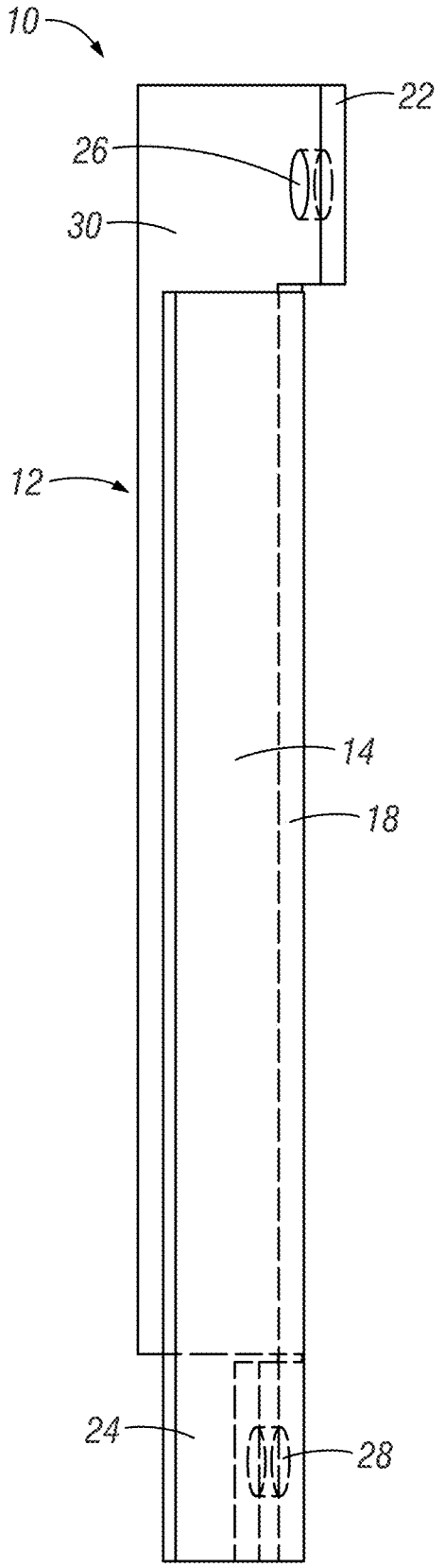
FIG. 3 is a side view of the support member bracket of FIG. 1 according to aspects of the disclosure.
Figure 4:
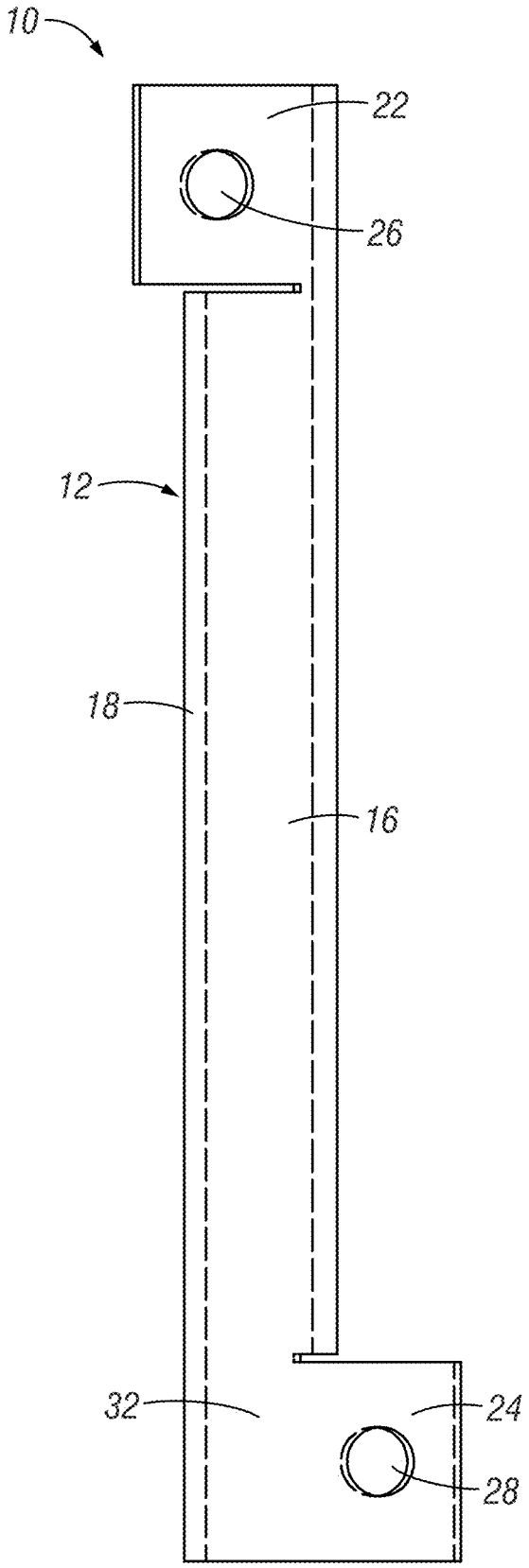
FIG. 4 is a front view of the support member bracket of FIG. 1 according to aspects of the disclosure.
Figure 5:
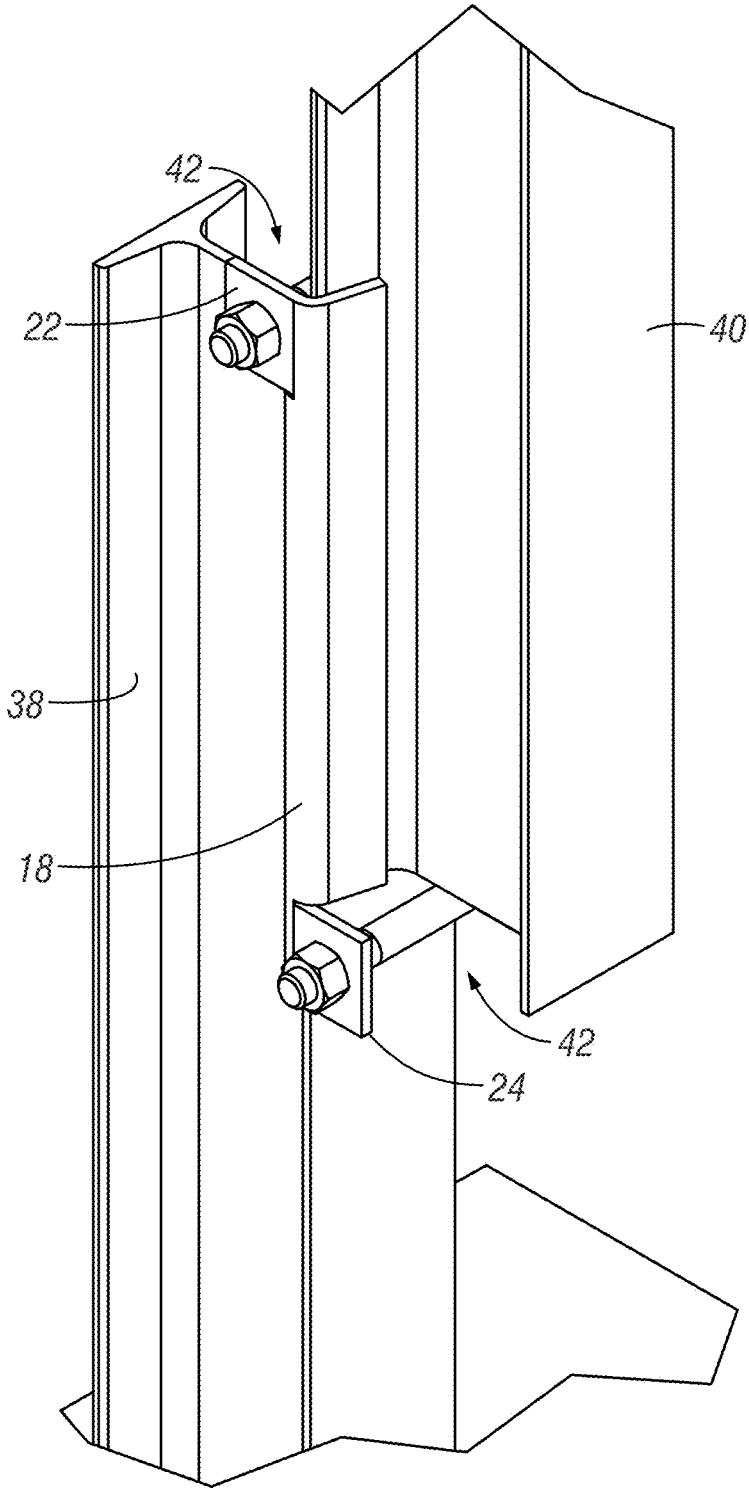
FIG. 5 is a perspective view of one embodiment of a support member extension system.
Figure 6:
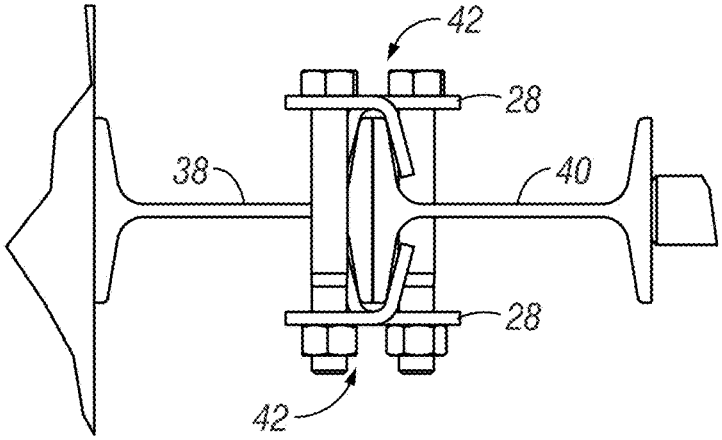
FIG. 6 is a top view of the support member extension system of FIG. 5 according to aspects of the disclosure.
Figure 7:
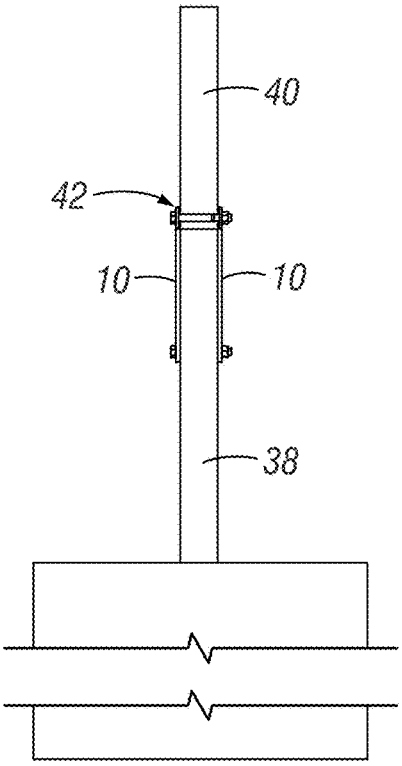
FIG. 7 is a rear view of the support member extension system of FIG. 5 according to aspects of the disclosure.
Figure 8:
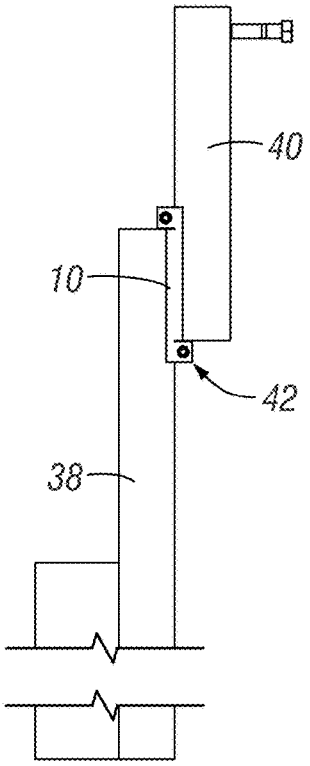
FIG. 8 is a side view of the support member extension system of FIG. 5 according to aspects of the disclosure.
Figure 9:
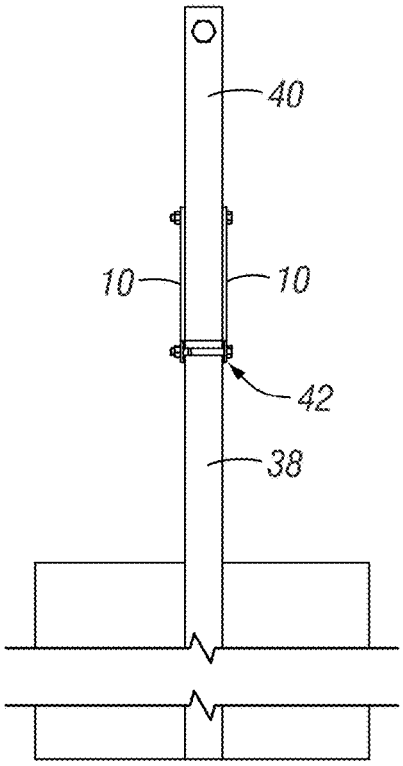
FIG. 9 is a front view of the support member extension system of FIG. 5 according to aspects of the disclosure.
Figure 10:
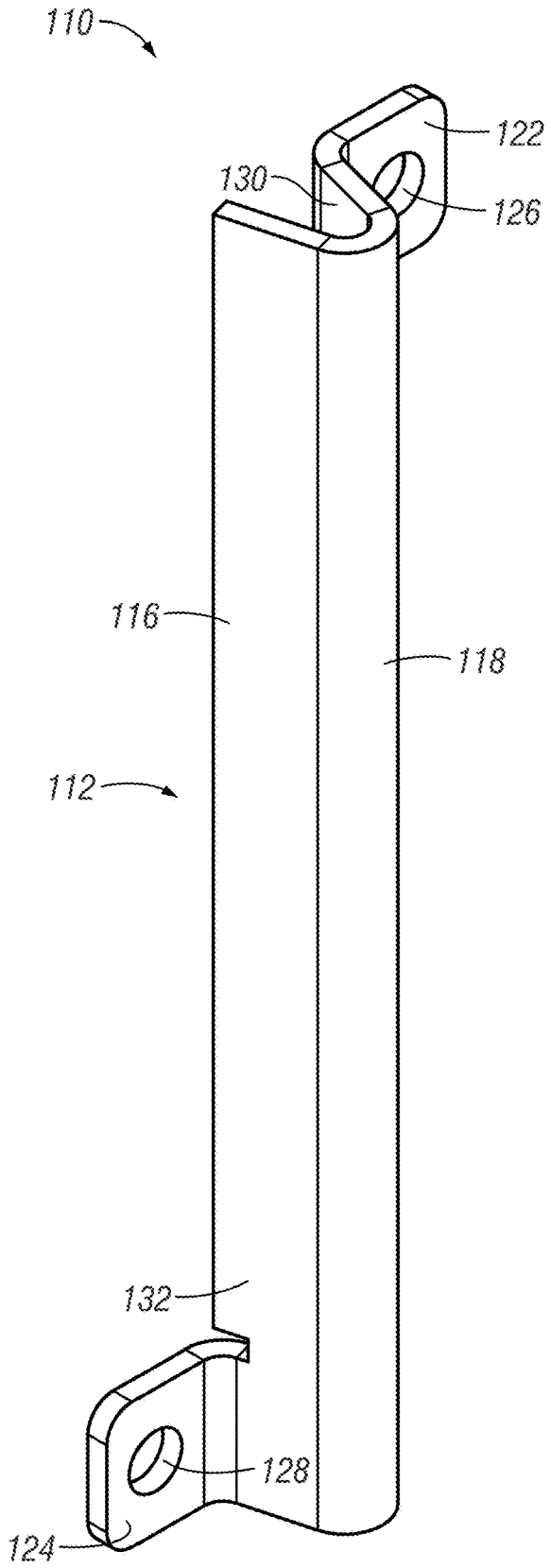
FIG. 10 is a perspective view of another support member bracket.

According to some aspects of the disclosure, the first planar portion or leg 14 and the second planar portion or leg 16 are symmetric about a plane 44 bisecting the first planar portion and the second planar portion (the plane 44 indicated by the axis in FIG. 2, said axis essentially extending through the page in the direction of the bracket or web 12). The first mounting portion or tab 22 and the second mounting portion or tab 24 are mirrored about the same plane bisecting the first planar portion and the second planar portion. In other words, if the extension support member 10 were stood up on one end and subsequently rotated one hundred eighty degrees such that the extension support member 10 were stood up on the opposite end, the extension support member 10 would appear identical.

FIGS. 5-9 show the extension support member 10 in combination with an additional extension support member 10 and a means for fastening 42 the extension support members to one another. In a preferred embodiment, the means for fastening 42 the extension support members 10 to one another is a pair of nuts and bolts that fasten using the first and second apertures 26, 28 of the extension support members 10, as is shown. The fastening means 42 and brackets or webs 12 may form an extension system, which, when placed around a portion of a first vertical support member 38, a portion of the first extension support member 10, a portion of a second vertical support member 40, and a portion of the second extension support member 10, will preferably hold them in close proximity. In the preferred embodiment, the extension support member 10 is supported by resting on a second, bottom nut and bolt assembly and the bracket is further supported by a first, top nut and bolt assembly, which may include a sheath or additional bracketing. The friction between the brackets or webs 12 and the extension support member 10 may also bear some of the weight of the extension support member 10. The extension system includes an extension support member 10 and a bracket or web 12 configured to allow a vertical support member (e.g. 38, 40) to be extended as needed on site without the need for welding or carrying a variety of support member lengths. It is noted the means for fastening 42 the extension support members 10 to one another is not limited to the configuration means shown and may alternatively include a channel, clamps, or other means of fastening the first extension support member to a second, and typically shorter, extension support member. The vertical support members 38, 40 may comprise I-beams. The I-beams may be used to reinforce the foundation of a home or a subterranean wall.

FIGS. 10-13 show various views of an alternative extension support member 110. The alternative extension support member includes a bracket or web 112. The bracket or web 112 includes a first planar portion or leg 114, a second planar portion or leg 116, an acute angle 120 between the first planar portion or leg 114 and the second planar portion or leg 116, and a bend or backbone 118 joining the first planar portion or leg 114 to the second planar portion or leg 116. The bracket or web 112 may be made out of a single piece of molded or formed material, so long as the material is strong enough to support the weight of the extension support member 110 and the forces applied through a vertical extension support member to the extension support member 110. The bracket or web 112 may be substantially u-shaped or v-shaped. The bend or backbone 118 may be a radial bend, may form an edge, or may be reinforced to provide for extra strength and to prevent failure.

The bracket or web 112 also includes a first mounting portion or tab 122 extending from the second planar portion or leg 116 via the bend or backbone 118 at a first obtuse angle 134 and a second mounting portion or tab 124 extending from the first planar portion or leg 114 via the bend or backbone 118 at a second obtuse angle 136. In the embodiment shown in FIGS. 10-13, the acute angle 120 is oriented to be concave (curving inward) and the first obtuse angle 134 and the second obtuse angle 136 are oriented to be convex (curving outward).

The first mounting portion or tab 122 is located at a toe end 130 of the bracket or web 112 and the second mounting portion or tab 124 is located at an opposite, head end 132 of the bracket or web 112. The first mounting portion or tab 122 may include a first aperture 126 and the second mounting portion or tab 124 may include a second aperture 128. The mounting portion or first tab 122 and the second mounting portion or tab 124 may be positioned within the same plane. According to some aspects of the disclosure, the second planar portion or leg 116 includes an additional backbone or bend which joins the second planar portion or leg 116 to the first mounting portion or tab 122 at the toe end 130 and the first planar portion or leg 114 includes an additional backbone or bend which joins the first planar portion or leg 114 to the second mounting portion or tab 124 at the head end 132. The mounting portions or tabs 122, 124 are shown as rectangles, but may be ovals (including circular), partial ovals (including semicircles), regular polygons (including equilateral triangles, etc.), irregular polygons, cones, any other known shapes, or any combination of the preceding shapes. Likewise, the apertures 126, 128 are shown as circles, but may be ovals (including circular), partial ovals (including semicircles), regular polygons (including equilateral triangles, etc.), irregular polygons, cones, any other known shapes, or any combination of the preceding shapes. The apertures are shown centrally located within the mounting portions or tabs 122, 124 but are not limited to such a location.

The extension support member 110 may also be made from the method comprising providing a S-shaped sheet of metal, folding the S-shaped sheet of metal along a longitudinal axis at an acute, concave angle 120 to form the bracket or web 112, cutting a first mounting portion or tab 122 out of the bracket or web 112 by horizontally cutting the bracket or web 112 a first distance below a first end of the bracket, cutting a second mounting portion or tab 124 out of the bracket or web 112 by horizontally cutting the bracket a second distance above the second end of the bracket or web 112, wherein the first mounting portion or tab 122 and the second mounting portion or tab 124 are located on opposite sides of the bracket or web 112, punching apertures 126, 128 through the first mounting portion or tab 122 and the second mounting portion 124, and folding the mounting portions or tabs 122, 124 in a convex direction such that the mounting portions or tabs 122, 124 are located within the same plane. The first distance and the second distance may be equal. The S-shaped sheet of metal may be obtained by cutting an S-shape out of a larger rectangular sheet of metal. The larger rectangular sheet of metal may be large enough to provide enough metal for multiple S-shaped sheets of metal and the S-shaped sheets of metal may be cut from the rectangular sheet of metal to ensure a minimum amount of waste metal is created.

Figure 11:
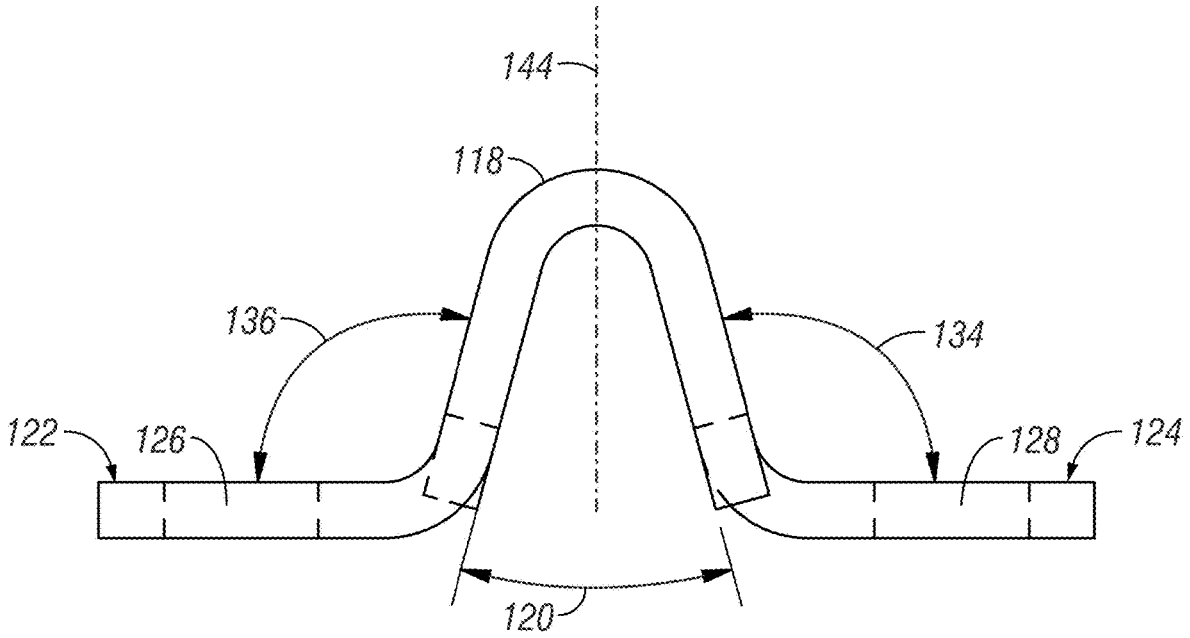
FIG. 11 is a top view of the support member bracket of FIG. 10 according to aspects of the disclosure.
Figure 12:
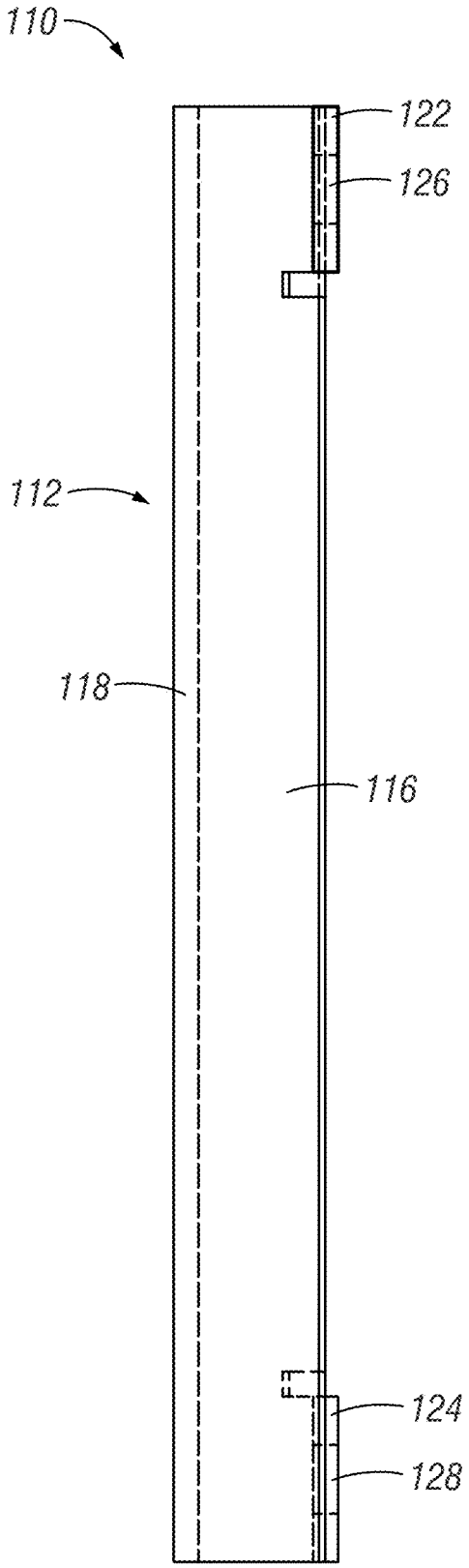
FIG. 12 is a front view of the support member bracket of FIG. 10 according to aspects of the disclosure.
Figure 13:
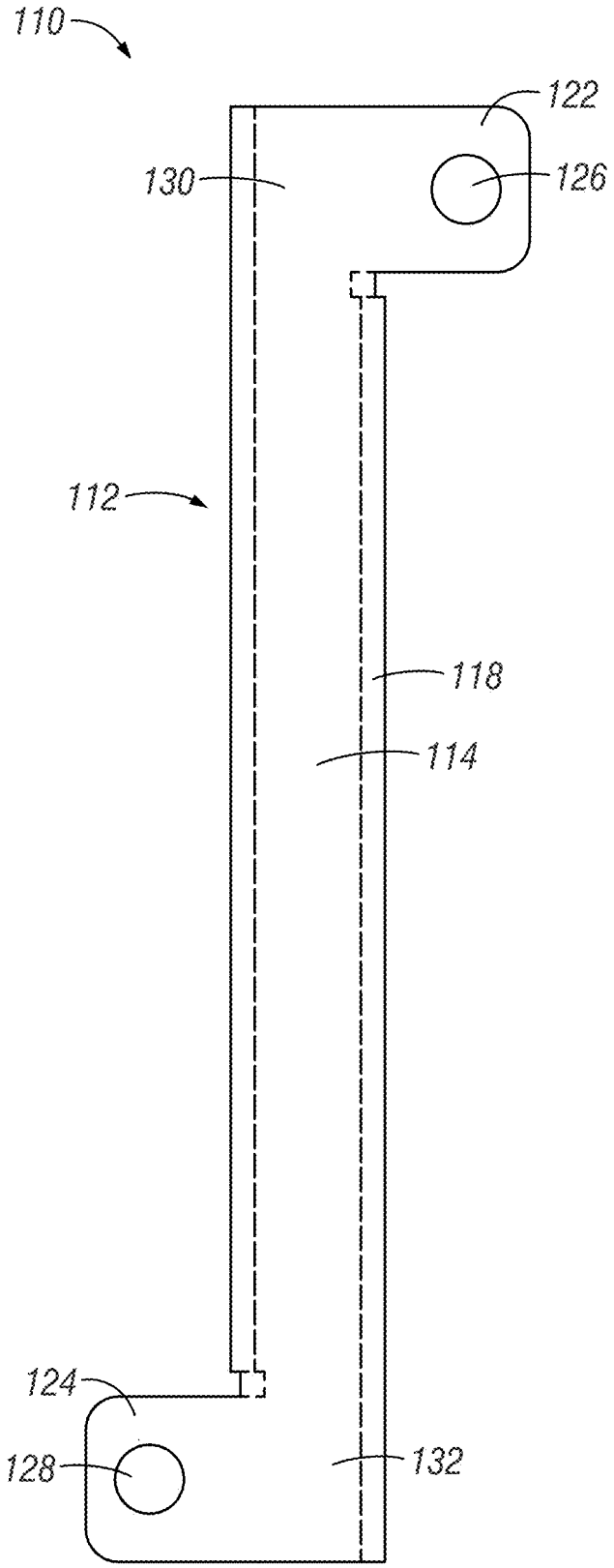
FIG. 13 is a side view of the support member bracket of FIG. 10 according to aspects of the disclosure.
Figure 14:
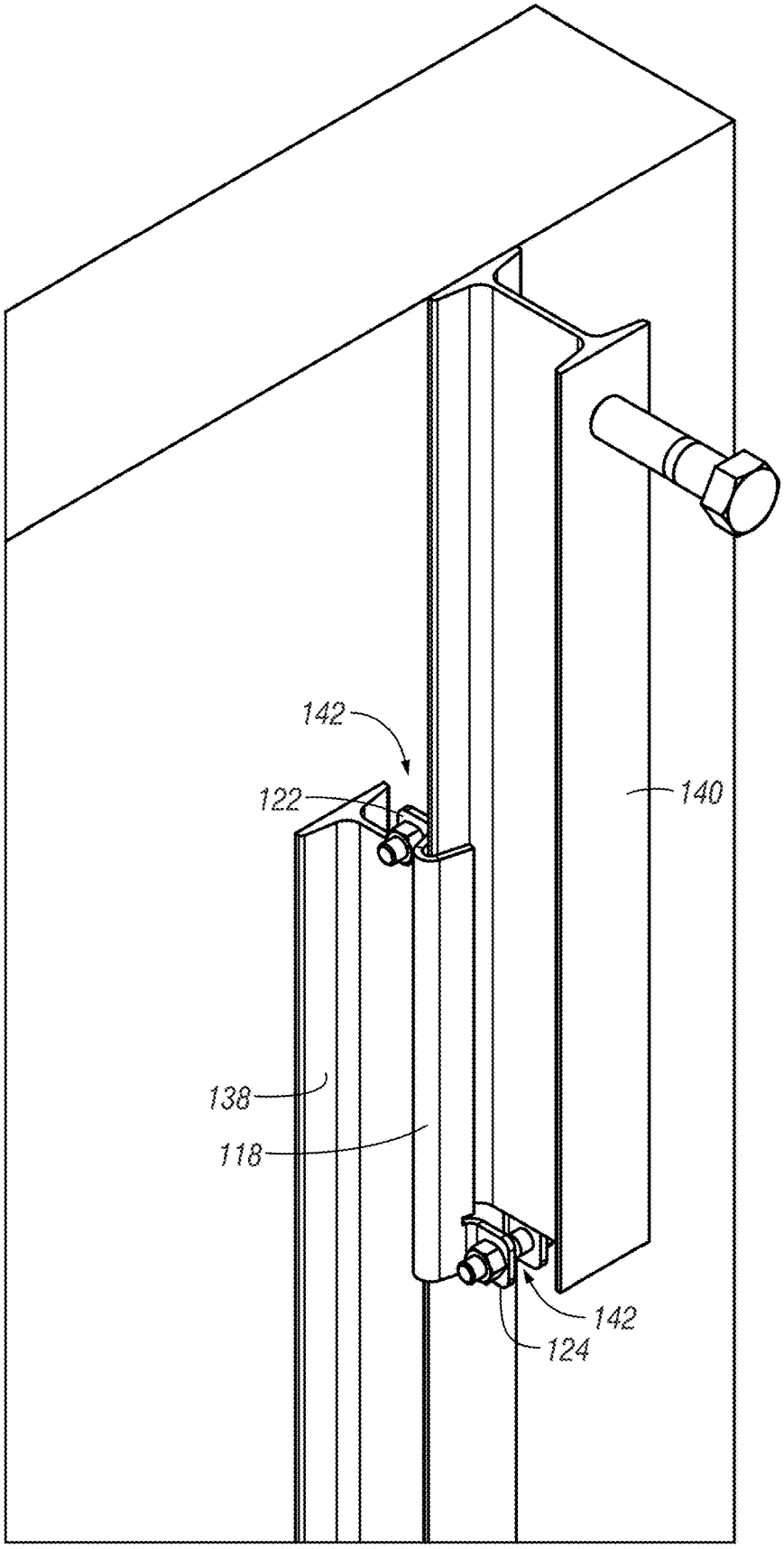
FIG. 14 is a perspective view of one embodiment of another support member extension system.
Figure 15:
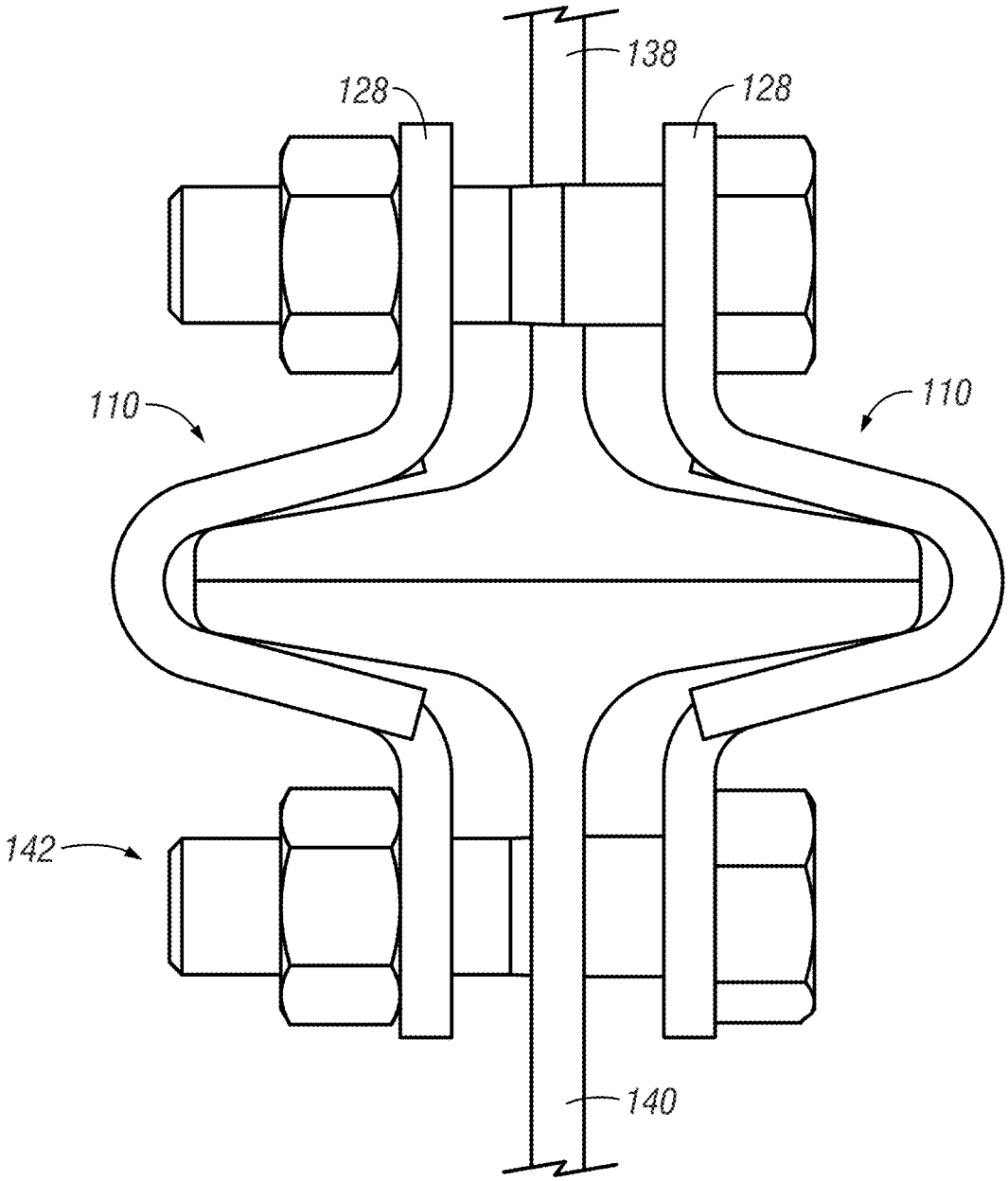
FIG. 15 is a top view of the support member extension system of FIG. 14 according to aspects of the disclosure.
Figure 17:
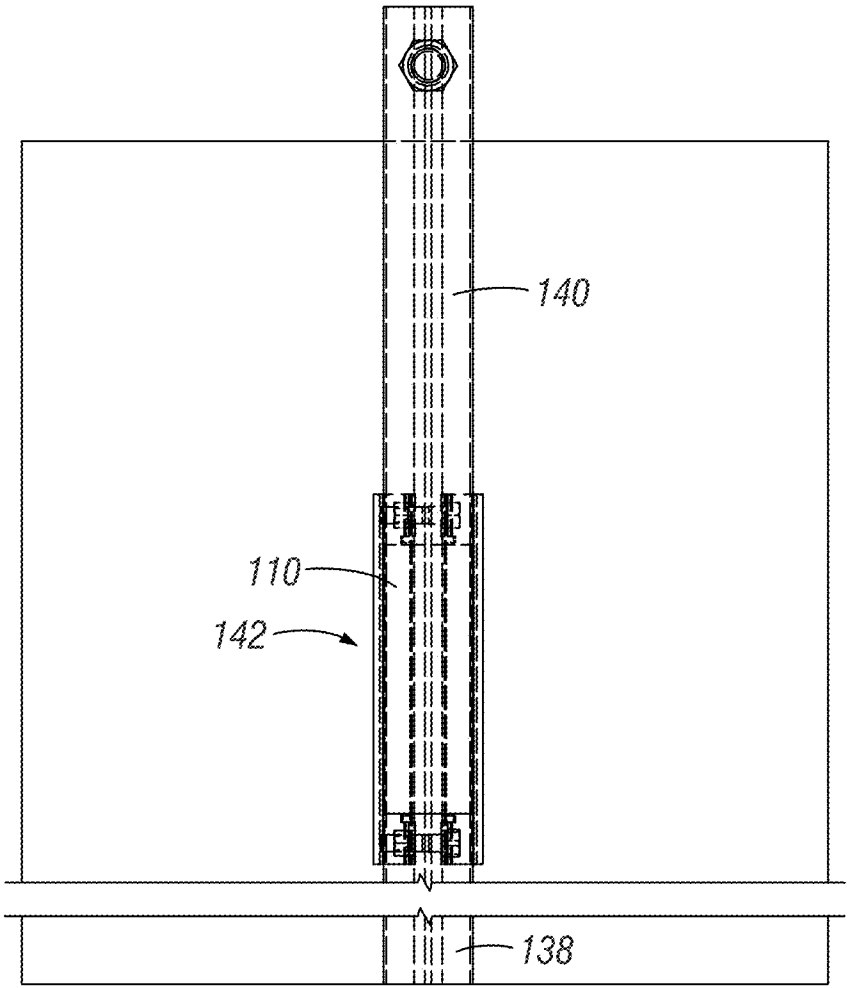
FIG. 17 is a front view of the support member extension system of FIG. 14 according to aspects of the disclosure.
Figure 16:
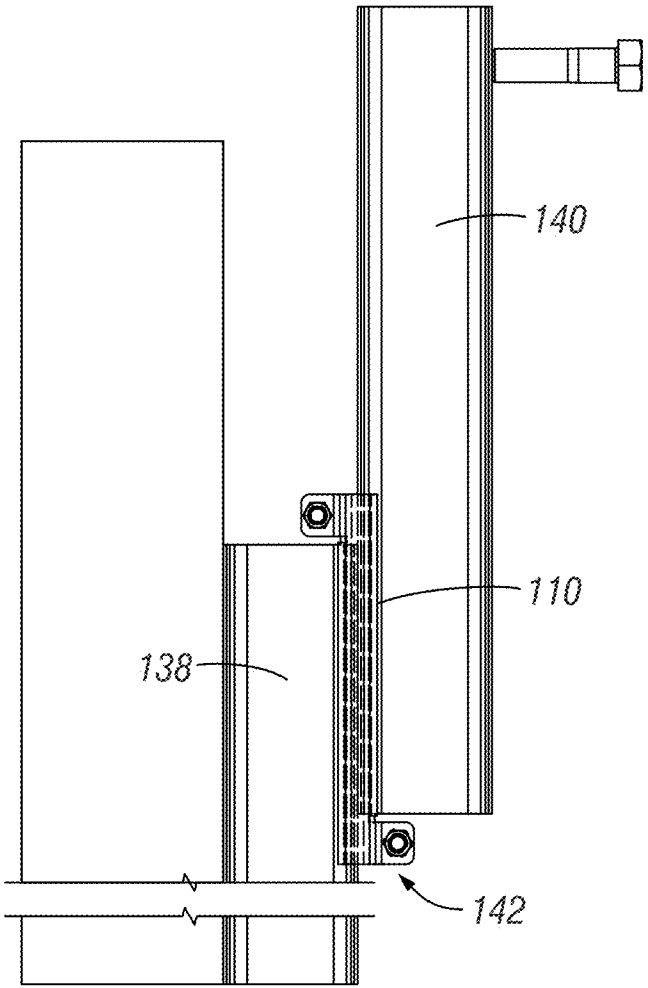
FIG. 16 is a side view of the support member extension system of FIG. 14 according to aspects of the disclosure.

According to some aspects of the disclosure, the first planar portion or leg 114 and the second planar portion or leg 116 are symmetric about a plane 144 bisecting the first planar portion and the second planar portion (the plane 144 indicated by the axis in FIG. 11, said axis essentially extending through the page in the direction of the bracket or web 112). The first mounting portion or tab 122 and the second mounting portion or tab 124 are mirrored about the same plane bisecting the first planar portion and the second planar portion. In other words, if the extension support member 110 were stood up on one end and subsequently rotated one hundred eighty degrees such that the extension support member 110 were stood up on the opposite end, the extension support member 110 would appear identical.

FIGS. 14-17 show the extension support member 110 in combination with an additional extension support member 110 and a means for fastening 142 the extension support members to one another. In a preferred embodiment, the means for fastening 142 the extension support members 110 to one another is a pair of nuts and bolts that fasten using the first and second apertures 126, 128 of the extension support members 110, as is shown. The fastening means 142 and brackets or webs 112 may form an extension system, which, when placed around a portion of a first vertical support member 138, a portion of the first extension support member 110, a portion of a second vertical support member 140, and a portion of the second extension support member 110, will preferably hold them in close proximity. In the preferred embodiment, the extension support member 110 is supported by resting on a second, bottom nut and bolt assembly and the bracket is further supported by a first, top nut and bolt assembly, which may include a sheath or additional bracketing. The friction between the brackets or webs 112 and the extension support member 110 may also bear some of the weight of the extension support member 110. The extension system includes an extension support member 110 and a bracket or web 112 configured to allow a vertical support member (e.g. 138, 140) to be extended as needed on site without the need for welding or carrying a variety of support member lengths. It is noted the means for fastening 142 the extension support members 110 to one another is not limited to the configuration means shown and may alternatively include a channel, clamps, or other means of fastening the first extension support member to a second, and typically shorter, extension support member. The vertical support members 138, 140 may comprise I-beams. The I-beams may be used to reinforce the foundation of a home or a subterranean wall.

Non-Limiting Examples of Dimensions

In a preferred embodiment, the acute angle 20 is thirty degrees, the first obtuse angle 34 is one hundred five degrees and the second obtuse angle 36 is one hundred five degrees. The web or bracket 12 may extend a length of 8.0 inches. The planar portions or legs 14, 16 may have a length of approximately 0.87 inches. The mounting portions or tabs 22, 24 may be A36 grade, have a 0.188 inch gauge, and extend a length of 1.5 inches (described as the "first distance" and the "second distance" above). The apertures 26, 28 may have a diameter of 0.52 inches.

In another preferred embodiment, the acute angle 120 is thirty degrees, the first obtuse angle 134 is one hundred five degrees and the second obtuse angle 136 is one hundred five degrees. The web or bracket 112 may extend a length of 8.0 inches. The planar portions or legs 114, 116 may have a length of approximately 0.87 inches. The mounting portions or tabs 122, 124 may be A36 grade, have a 0.19 inch gauge, and extend a length of 1.25 inches (described as the "first distance" and the "second distance" after cutting). The apertures 126, 128 may have a diameter of 0.52 inches.

LIST OF REFERENCE NUMERALS

The following reference numerals are provided to facilitate an understanding of the present disclosure and are not an exhaustive list of every element contained within the present disclosure. Provided it is possible to do so, elements identified by a numeral may be replaced or used in combination with any elements identified by a separate numeral. Additionally, numerals are not limited to the descriptors provided herein and include equivalent structures and other objects possessing the same function and/or that may be able to perform the same function in substantially the same way in an order to obtain substantially the same result.

10 extension support member
12 bracket/web
14 first planar portion/first leg
16 second planar portion/second leg
18 bend/backbone
20 acute angle
22 first mounting portion/first tab
24 second mounting portion/second tab
26 first aperture
28 second aperture
30 first end/first extension
32 second end/second extension
34 first obtuse angle
36 second obtuse angle
38 first I-beam
40 second I-beam
42 fastening means
44 plane bisecting the bracket/web
110 alternative extension support member
112 bracket/web
114 first planar portion/first leg
116 second planar portion/second leg
118 bend/backbone
120 acute, concave angle
122 first mounting portion/first tab
124 second mounting portion/second tab
126 first aperture
128 second aperture
130 toe end
132 head end
134 first obtuse, convex angle
136 second obtuse, convex angle
138 first I-beam
140 second I-beam
142 fastening means
144 plane bisecting the bracket/web The disclosure is not to be limited to the particular embodiments described herein. The previous detailed description is of a small number of embodiments for implementing the disclosure and is not intended to be limiting in scope. The following claims set forth a number of the embodiments of the disclosure with greater particularity.

What is claimed is:

1. An extension support member, comprising:

a bracket having a first planar portion, a second planar portion, an acute, concave angle between the first planar portion and the second planar portion, and a first bend joining the first planar portion to the second planar portion;

a first mounting portion joined to the second planar portion via a second bend at a first obtuse, convex angle; and a second mounting portion joined to the first planar portion via a third bend at a second obtuse, convex angle;

wherein the first mounting portion and the second mounting portion are located at opposite ends of the bracket.

2. The extension support member of claim 1, wherein the first mounting portion includes a first aperture and the second mounting portion includes a second aperture.

3. The extension support member of claim 2, wherein the first aperture is centrally located within the first mounting portion and the second aperture is centrally located within the second mounting portion.

4. The extension support member of claim 2 in combination with an additional extension support member and a means for fastening the extension support members to one another.

5. The extension support member of claim 4 wherein the means for fastening the extension support members to one another is a pair of nuts and bolts that fasten using the first and second apertures of the extension support members.

6. The extension support member of claim 4 in further combination with a first vertical support member and a second vertical support member, wherein the extension support members and the means for fastening the extension support members secure the vertical support members to one another.

7. The extension support member of claim 6 wherein the first vertical support member and the second vertical support member are I-beams.

8. The extension support member of claim 6 wherein the first vertical support member is longer than the second vertical support member.

9. The extension support member of claim 1, wherein the first bend is a radial bend.

10. The extension support member of claim 1, wherein the acute, concave angle is thirty degrees, the first obtuse, convex angle is one hundred five degrees and the second obtuse, convex angle is one hundred five degrees.

11. The extension support member of claim 1, wherein the first planar portion and the second planar portion are symmetric about a plane bisecting the first planar portion and the second planar portion.

12. The extension support member of claim 11, wherein the first mounting portion and the second mounting portion are mirrored about the plane bisecting the first planar portion and the second planar portion.

13. An extension support member, comprising:

a first tab and a second tab positioned in the same plane;

a u-shaped or v-shaped web having:

a first leg;

a second leg; and a bend or a fold formed around a longitudinal axis separating the first leg and the second leg;

wherein the first tab extends from the web at a toe end of the longitudinal axis and the second tab extends from a head end of the longitudinal axis;

wherein the first tab is joined to the web via a first backbone or bend and the second tab is joined to the web via a second backbone or bend.

14. The extension support member of claim 13, wherein the first and second tabs have an aperture.

15. The extension support member of claim 13, wherein the first leg and the second leg are symmetric about a plane bisecting the first leg and the second leg.

16. The extension support member of claim 15, wherein the first tab and the second tab are mirrored about the plane bisecting the first leg and the second leg.

* * * * *